US007040860B2

(12) United States Patent
Newman et al.

(10) Patent No.: US 7,040,860 B2
(45) Date of Patent: May 9, 2006

(54) UNI-DIRECTIONAL IMPELLER, AND IMPELLER AND ROTOR ASSEMBLY

(75) Inventors: Daniel A. Newman, Roanoke, VA (US); Joseph C. Carley, Blacksburg, VA (US)

(73) Assignee: Tetra Holding (US), Inc., Blacksburg, VA (US)

( * ) Notice: Subject to any disclaimer, the term of this patent is extended or adjusted under 35 U.S.C. 154(b) by 98 days.

(21) Appl. No.: 10/788,753

(22) Filed: Feb. 27, 2004

(65) Prior Publication Data

US 2004/0179942 A1 Sep. 16, 2004

Related U.S. Application Data

(60) Provisional application No. 60/454,295, filed on Mar. 13, 2003.

(51) Int. Cl.
*F04D 29/60* (2006.01)

(52) U.S. Cl. ..... 415/123; 416/170 R; 417/423.1; 417/423.6

(58) Field of Classification Search ..... 416/244 R, 416/170 R; 415/123; 417/214, 212, 316, 417/423.7, 423.6, 423.1
See application file for complete search history.

(56) References Cited

U.S. PATENT DOCUMENTS

| | | | | |
|---|---|---|---|---|
| 3,872,334 | A | 3/1975 | Loubier | |
| 4,204,810 | A | 5/1980 | Vogel | |
| 4,407,641 | A | 10/1983 | Long | |
| 4,512,885 | A | 4/1985 | Willinger | |
| 4,549,157 | A | 10/1985 | Loubier | |
| 4,589,982 | A | 5/1986 | Willinger | |
| 4,602,996 | A | 7/1986 | Willinger | |
| 4,678,568 | A | 7/1987 | Goldman et al. | |
| 4,678,616 | A | 7/1987 | Kawashima | |
| 4,735,715 | A | 4/1988 | Willinger | |
| 4,761,227 | A | 8/1988 | Willinger et al. | |
| 4,861,468 | A | 8/1989 | Willinger et al. | |
| 5,039,286 | A * | 8/1991 | Point et al. | 417/424.1 |
| 5,158,440 | A | 10/1992 | Cooper et al. | |
| 5,238,367 | A | 8/1993 | Ellis et al. | |
| 5,273,394 | A | 12/1993 | Samuel | |
| 5,282,961 | A | 2/1994 | Ellis et al. | |
| 5,290,227 | A | 3/1994 | Pasque | |
| 5,449,269 | A | 9/1995 | Frank et al. | |
| 5,513,950 | A | 5/1996 | Yu | |
| 5,516,259 | A | 5/1996 | Niederkofler et al. | |
| 5,586,862 | A | 12/1996 | Danner | |
| 5,714,814 | A | 2/1998 | Marioni | |
| 6,113,363 | A | 9/2000 | Talaski | |
| 6,158,984 | A | 12/2000 | Cao et al. | |
| 6,227,817 | B1 | 5/2001 | Paden | |
| 6,264,635 | B1 | 7/2001 | Wampler et al. | |
| 6,425,733 | B1 | 7/2002 | Ross | |
| 6,488,484 | B1 | 12/2002 | Pettenon | |
| 6,524,078 | B1 * | 2/2003 | Brooks et al. | 417/223 |

FOREIGN PATENT DOCUMENTS

| | | |
|---|---|---|
| DE | 31 36 383 A1 | 3/1983 |
| DE | 35 16 061 A1 | 1/1986 |

* cited by examiner

*Primary Examiner*—Edward K. Look
*Assistant Examiner*—Nathan Wiehe
(74) *Attorney, Agent, or Firm*—Merchant & Gould P.C.

(57) ABSTRACT

An impeller, and impeller and rotor assembly, for use with a permanent magnet motor that provide uni-directional rotation. The impeller and rotor assembly includes an interconnecting arrangement and a locking arrangement that permit continuous rotation in a first direction and prevent continuous rotation in a second opposite direction.

20 Claims, 4 Drawing Sheets

UNI-DIRECTIONAL IMPELLER, AND IMPELLER AND ROTOR ASSEMBLY

CROSS-REFERENCE TO RELATED APPLICATIONS

This application claims the benefit of a U.S. Provision Application No. 60/454,295, filed on Mar. 13, 2003; which application is incorporated herein by reference.

TECHNICAL FIELD

This disclosure relates generally to an impeller for use with a permanent magnet motor. In particular, the present disclosure relates to a unidirectional impeller and rotor assembly that provides rotational operation of the impeller in a predetermined direction.

BACKGROUND

A wide variety of impeller arrangements have been utilized with two-pole or bipolar permanent magnetic motors. In conventional designs, the impellers are designed to rotate in both the clockwise direction and the counter-clockwise direction. This is because of the random nature of rotational startup of the motor. The random startup of such conventional design creates different operational flow rates, depending upon the direction of rotation, and thereby unpredictability in performance and efficiency.

Some impellers have been designed to provide a preset direction of rotation. One such impeller design is disclosed in U.S. Pat. No. 6,488,484. In this design, the blades of the impeller are configured to provide an imbalance of motor power versus fluid power. Thus, these types of impeller design require specific blade geometry to accomplish uni-directional rotation. Specific blade geometries that accomplish uni-directional rotation are often inefficient or have low performance ratings for particular applications. For example, some impellers having specific blade geometry cause a higher power draw on the motor than impellers having a more standard blade configuration. Similarly, impellers having specific blade geometry are significantly limited in permitting blade modifications to optimize performance because of the design constraint to provide the uni-directional rotation. In impeller designs having a specific blade geometry, performance and efficiency are sacrificed for consistency of directional rotation.

In general, improvement has been sought with respect to such impeller designs, generally to: provide unidirectional rotation without sacrificing performance, and permit use of a variety of a high performance impeller blade configurations while still providing a known direction of rotation.

SUMMARY

One aspect of the present disclosure relates to an assembly including a rotor and an impeller. The assembly includes an arrangement that interconnects the rotor and the impeller. The arrangement is designed to permit continuous rotation of the rotor and the impeller in a first direction, and prevent continuous rotation of the rotor in a second opposite direction. The arrangement includes a first interconnecting structure configured to rotate in concert with the rotor, and a second interconnecting structure configured to rotate in concert with the impeller.

Another aspect of the present disclosure relates to an impeller and rotor assembly including a shaft having a first end and a second end. A rotor is mounted on the shaft adjacent to the first end. The rotor includes a first interconnecting structure positioned at a first end of the rotor, and a first locking structure positioned at a second end of the rotor. An impeller is mounted on the shaft adjacent to the second end of the shaft. The impeller includes a second interconnecting structure corresponding to the first interconnecting structure of the rotor. The assembly also includes a first end cap mounted on the first end of the shaft and a second end cap mounted on the second end of the shaft. The second end cap includes a second locking structure corresponding to the first locking structure of the rotor. The second locking structure prevents rotation of the rotor in a predetermined direction.

Still another aspect of the present disclosure relates to an impeller having a main body and a plurality of blades extending from the main body. The impeller includes a cam structure having an incline surface and an engagement surface. The cam structure is configured to provide contact between the engagement surface and a component of a permanent magnetic motor when the motor rotates in a first direction and provide contact between the incline surface and a component of the motor when the motor rotates in a second direction.

Yet another aspect of the present disclosure relates to a method of limiting rotation of a motor in a predetermined direction. The method includes providing a rotor with a locking structure and providing an impeller. The rotor is axially displaced from a first position adjacent to the impeller to a second position located a distance from the impeller when the motor rotates in the predetermined direction. The locking structure of the rotor engages with a fixed arrangement to prevent continuous rotation of the motor in the predetermined direction.

A variety of aspects of the invention are set forth in part in the description that follows, and in part will be apparent from the description, or may be learned by practicing various aspects of the disclosure. The aspects of the disclosure may relate to individual features as well as combinations of features. It is to be understood that both the foregoing general description and the following detailed description are exemplary and explanatory only, and are not restrictive of the claimed invention.

DETAILED DESCRIPTION

The present disclosure will be described with reference to an impeller for use with a permanent magnet motor. In particular, the present disclosure relates to an impeller assembled with a rotor, the assembly being configured to permit continuous rotation in a desired first direction and prevent continuous rotation in an opposite or undesired second direction. What is meant by "continuous rotation" is that the impeller and rotor assembly is permitted to normally operate or rotate in the first direction for an unlimited number of revolutions, as desired by a user and permitted by the life of the motor. When continuous rotation is not permitted in the opposite direction, that means the impeller and rotor assembly is prevented from rotating in the opposite direction for an unlimited number of revolution; in other words, the number of revolutions in the opposite direction is limited.

Figure 1:
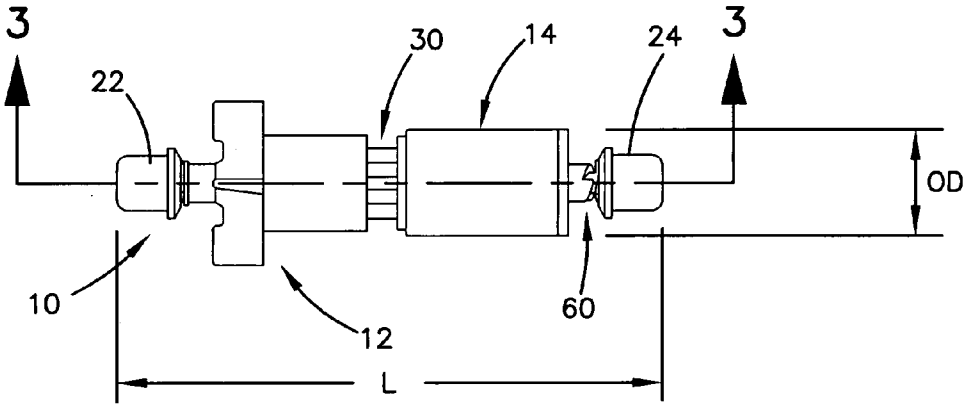
FIG. 1 is an elevational side view of one embodiment of an impeller and rotor assembly in accord with the principles of the present disclosure.

FIG. 1 illustrates one embodiment of the impeller and rotor assembly 10 in accord with the principles disclosed. The assembly 10 generally includes an impeller 12 and rotor 14. The impeller and rotor assembly 10 also includes an interconnecting arrangement 30 and a locking arrangement 60. The interconnecting arrangement 30 interconnects the rotor 14 and the impeller 12 so that the impeller 12 rotates in concert with the rotor 14 when the rotor rotates in a desired first direction. The interconnecting arrangement 30 also functions to operably engage the locking arrangement 60 to prevent continuous rotation of the rotor in the second, opposite or undesired direction. The interconnecting arrangement 30, the locking arrangement 60, and the rotational operations of the assembly 10 will be discussed in greater detail hereinafter.

Figure 2:
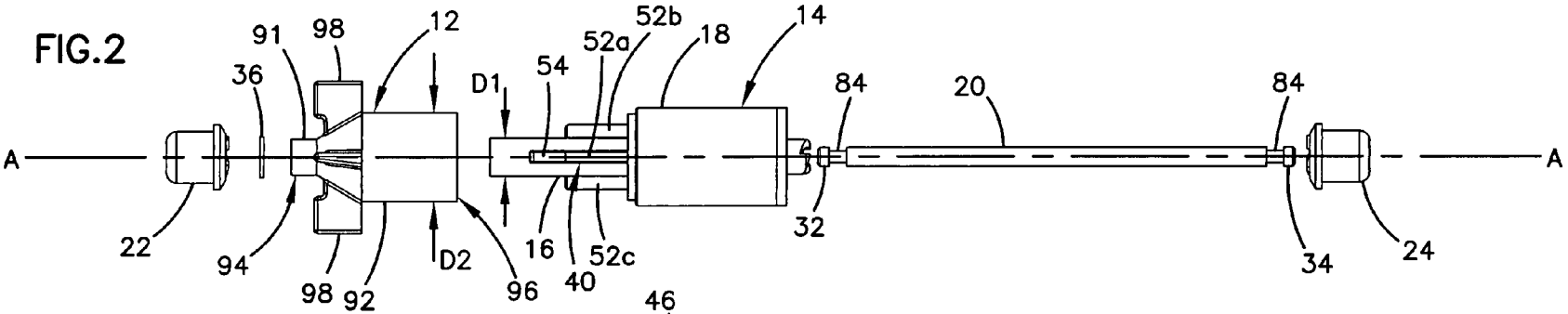
FIG. 2 is an exploded side view of the impeller and rotor assembly of FIG. 1.
Figure 3:
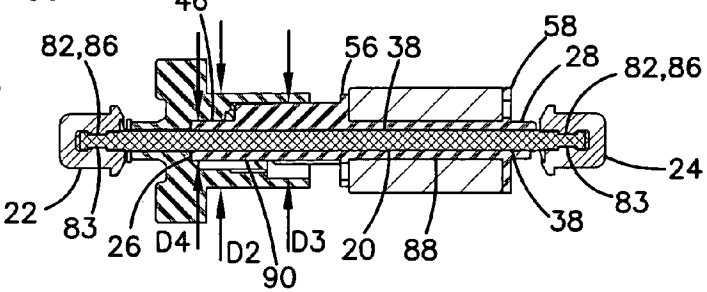
FIG. 3 is a cross-sectional view of the impeller and rotor assembly of FIG. 1, taken along line 3—3.
Figure 4:
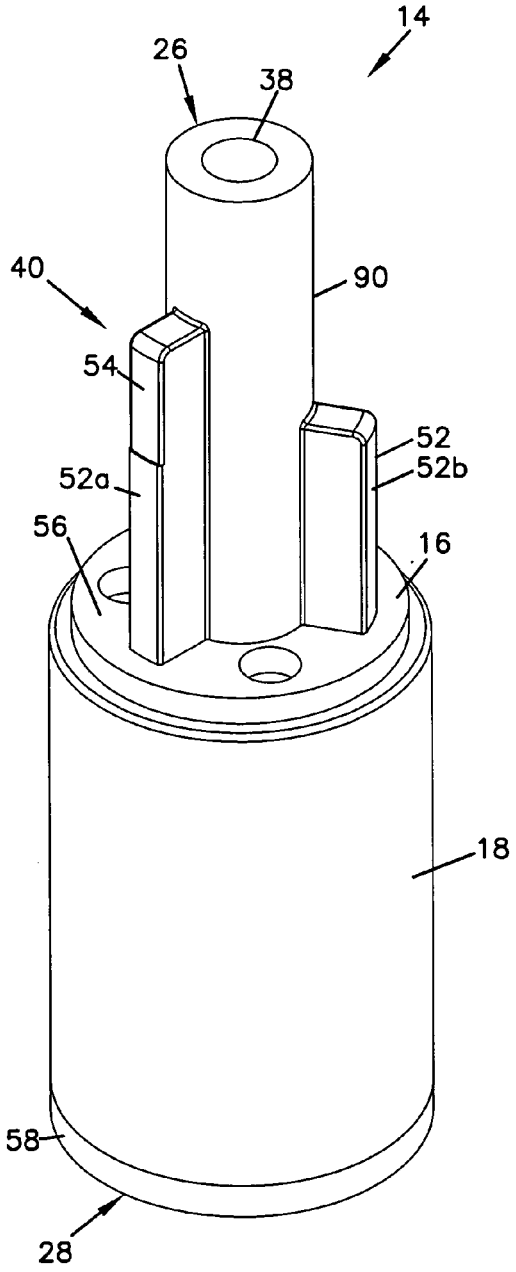
FIG. 4 is a perspective top view of one embodiment of a rotor, in accord with the principles of the present disclosure, and illustrated in FIG. 1.

FIG. 2 illustrates the assembly 10 in an exploded view. The assembly 10 has a longitudinal axis A—A. The longitudinal axis A—A is generally defined by a central shaft 20. The impeller 12 is positioned on the shaft 20 adjacent to a first end 32 of the shaft 20, and the rotor 14 is positioned on the shaft 20 adjacent to a second end 34 of the shaft 20. A first end cap 22 and a second end cap 24 secure the impeller 12 and rotor 14 to the shaft 20 (FIG. 3).

In particular, the first and second end caps 22, 24 include attachment structure 82 that couples the end caps to the shaft 20. The illustrated attachment structure 82, as shown in FIG. 3, includes a central bore 83 having an annular protrusion 86 that corresponds to a groove 84 formed on the shaft 20. The end caps are typically made of rubber, thus the end caps 22, 24 can be slid onto the ends of the shaft 20 such that the annular protrusion 86 engages the groove 84 to hold the assembly together. It is contemplated that other forms of attachment structure such as snap rings, for example, can be used to couple the end caps to the shaft or hold the assembly together. Thereby it is further contemplated that the end caps can be at least partially made of materials other than rubber that are suitable with alternative attachment structures for holding the assembly together.

Referring back to FIG. 1, the assembly 10 has an overall length L and outer diameter OD, although the disclosed principles can be applied in a variety of sizes and applications. The length L of the assembly is generally defined between the first and second end caps, 22, 24 and is preferably between 4 cm and 12 cm (2 inches and 4.7 inches); more preferably the length L is between 7 cm and 9.5 cm. The outer diameter OD of the assembly is generally defined by the outer diameter of the rotor 14, and is preferably between 0.3 cm and 3.5 cm (0.1 inches and 1.4 inches); more preferably the outer diameter OD is between 0.8 cm and 2.5 cm.

Referring now to FIGS. 2–5, the rotor 14 generally includes a rotor member 16 and a magnet 18. The magnet 18 is positioned between a first flange 56 and second flange 58 of the rotor member 16. A bore 38 (FIG. 3) extends through the rotor member 16 from a first end 26 of the rotor member 16 to a second end 28. The bore 38 is sized and configured for receipt of the shaft 20. The rotor member 16 includes a magnet mount portion 88 and an extension portion 90. The magnet mount portion 88 generally extends between the first and second flanges 56, 58, and is sized and configured for receipt of the magnet 18. The magnet mount portion 88 can also include a keyway or keyed construction to prevent separation of the magnet 18 from the mount portion 88.

The extension portion 90 of the rotor member 16 generally extends from the first flange 56 to the first end 26 of the rotor member 16. The extension portion 90 has a diameter D1 (FIG. 2) sized and configured in correspondence to the impeller 12. Fins 52 radially extend from the diameter D1 of the extension portion 90. In the illustrated embodiment of FIG. 2, three fins 52*a*, 52*b*, and 52*c* are provided along the extension portion 90, although other configurations having a different number of fins, or other geometry, can be used in accord with the principles disclosed. Typically the fins 52 are spaced at approximately equal distances from one another about the diameter D1 of the extension portion 90. Each of the three fins 52*a*, 52*b*, and 52*c* shown is spaced approximately 120 degrees relative to one anther. Preferably, one of the fins 52*a* includes a rib extension 54. The rib extension 54 in essence extends or increases the length of the one associated fin 52*a*. That is, the one fin 52*a* having the rib extension 54 extends a distance from the first flange 56 farther than the distance at which the other fins 52*b*, 52*c* extend.

Figure 7:
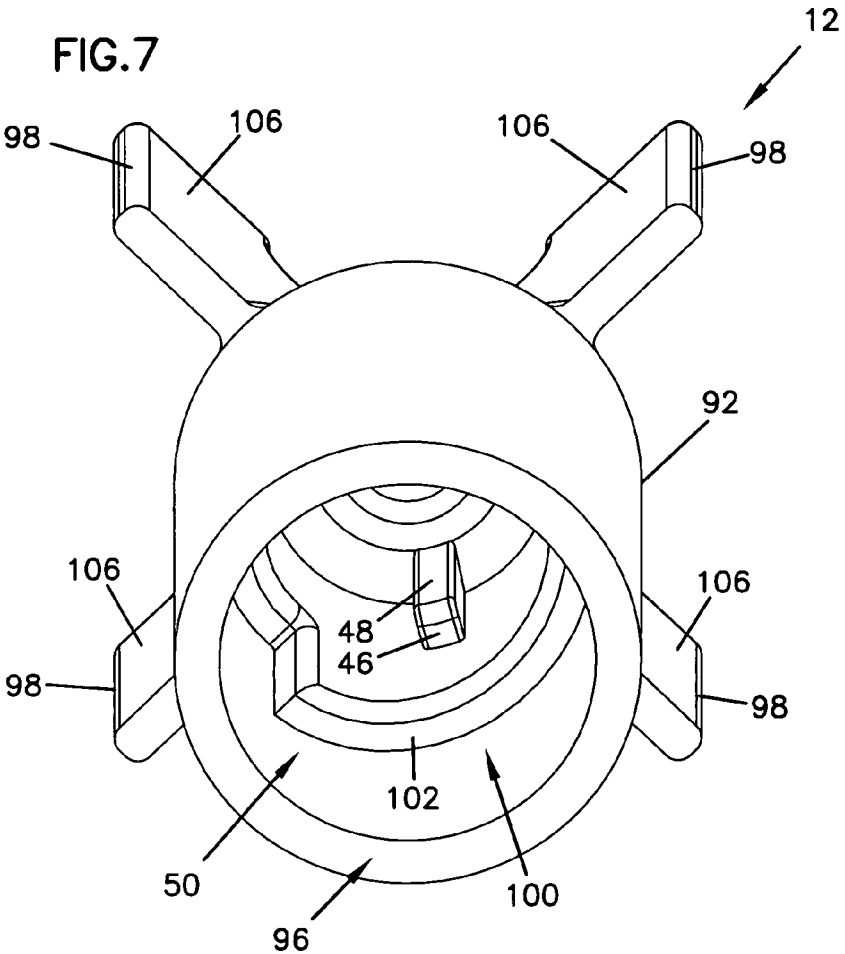
FIG. 7 is a second perspective bottom view of the impeller of FIG. 6.
Figure 6:
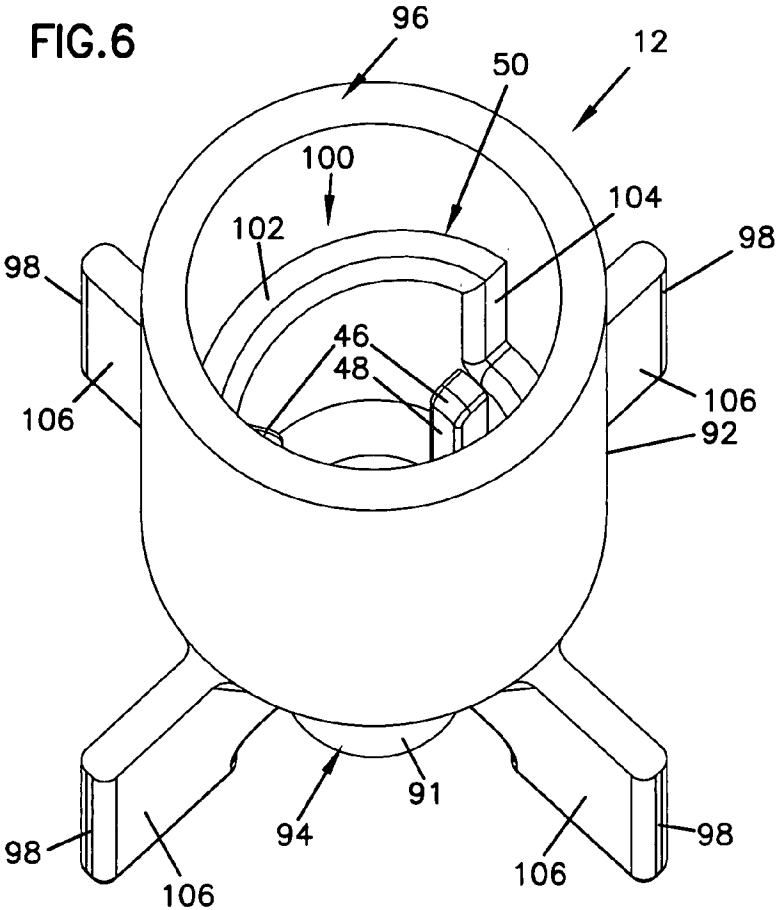
FIG. 6 is a first perspective bottom view of one embodiment of an impeller, in accord with the principles of the present disclosure, and illustrated in FIG. 1.

Referring now to FIGS. 6 and 7, the impeller 12 of the impeller and rotor assembly 10 generally has a first end 94 and a second end 96, and includes a main body 92 and a nosepiece 91 located adjacent to the first end 94. The main body 92 has an outer diameter D2 (FIG. 2) and a primary inner diameter D3 (FIG. 3). The primary inner diameter D3 extends from the second end 96 toward the first end 94. Extending from the primary inner diameter D3 is a secondary inner diameter D4. The secondary diameter D4 corresponds to the outer diameter D1 of the extension portion 90 of the rotor member 16. As shown in FIG. 3, the extension portion 90 of the rotor member 16 is sized for receipt within the secondary inner diameter D4 of the impeller 12. Likewise, the fins 52 of the rotor member 16 are sized to correspond to the configuration of the primary inner diameter D3 of the impeller 12. The fins 52 prevent the impeller from rocking, somewhat like a bell, when the impeller 12 and rotor 14 are assembled.

Still referring to FIGS. 6 and 7, spacing members 46 are positioned within the primary inner diameter D3 of the impeller 12. The spacing members 46 project centrally from the inner diameter D3 and provide alignment surfaces 48 that define a diameter having generally the same diameter as the secondary inner diameter D4 of the impeller 12. The diameter defined by the spacing members 46 are sized and configured to support and align the diameter D1 of the extension portion 90 of the rotor member 16 (see FIG. 3). In the illustrated embodiment, the spacing members 46 are longitudinally oriented along the primary inner diameter D3 of the impeller 12. Other constructions that support and align the extension portion or define the secondary inner diameter D4, such as a collar, for example, can be used.

The impeller 12 also includes vanes or blades 98 located adjacent to the first end 94 of the main body 92. The blades 98 radially extend outward from the main body 92. In the illustrated embodiment, the impeller 12 includes four blades although other configurations having a different number of blades can be used in accord with the principles disclosed. Each of the four blades has a straight blade configuration. In particular, the blades 98 have a main portion 106 that extends radially outward from the main body 92 in a non-curved and generally perpendicular orientation. The blades can be configured with any type of geometry or blade configuration as will be discussed in greater detail hereinafter.

Referring again to FIG. 4, the rotor 14 includes a first interconnecting structure 40 that partially defines the interconnecting arrangement 30 of the assembly 10. The first interconnecting structure 40 rotates in concert with the rotor 14. Referring to FIG. 6, the impeller 12 includes a second interconnecting structure 50 that also partially defines the interconnecting arrangement 30 of the assembly 10. The second interconnecting structure 50 rotates in concert with the impeller 12. The second interconnecting structure 50 corresponds to the first interconnecting structure 40 to define the interconnecting arrangement 30 of the assembly 10.

The first interconnecting structure 40 includes the rib extension 54. The second interconnecting structure 50 includes an interconnecting cam structure 100. The interconnecting cam structure 100 has an incline surface 102 and an engagement surface 104. The incline surface 102 is configured in the shape of a helical structure or helix. The incline surface 102 abuts with the engagement surface 104 of the interconnecting cam structure 100.

Figure 10:
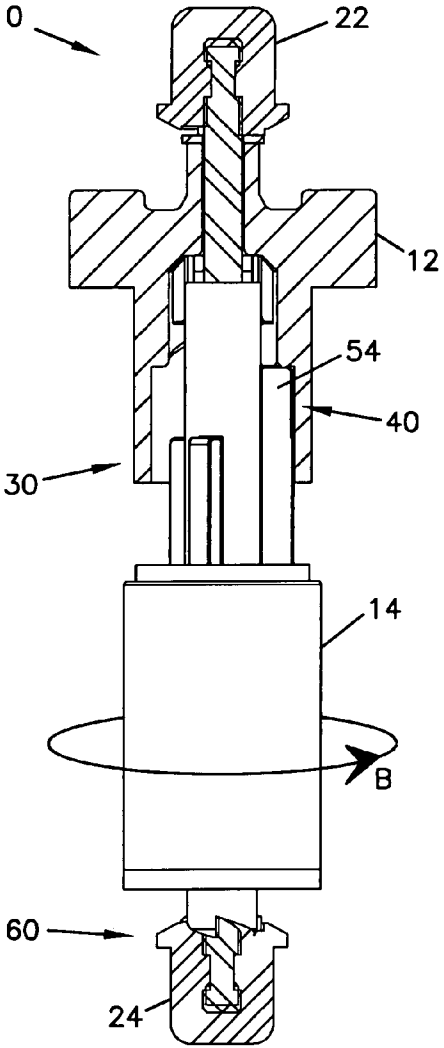
FIG. 10 is a partial cross-sectional view of the impeller and rotor assembly of FIG. 1, shown in a second position that prevents continuous rotation.
Figure 9:
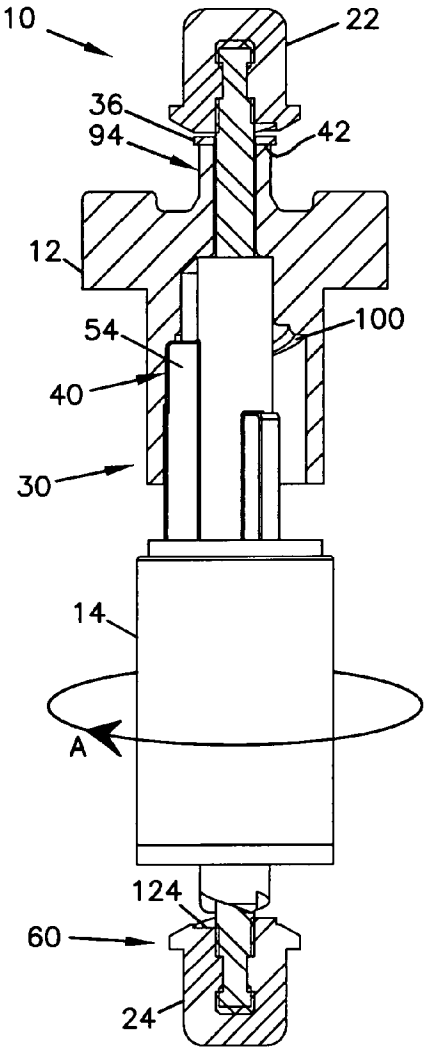
FIG. 9 is partial cross-sectional view of the impeller and rotor assembly of FIG. 1, shown in a first position that permits continuous rotation.

Referring now to FIGS. 9 and 10, the second interconnecting structure 50 operates in conjunction with the first interconnecting structure 40. In particular, the rib extension 54 of the first interconnecting structure 40 operably engages either the engagement surface 104 (as shown in FIG. 9) or the incline surface 102 (as shown in FIG. 10) of the second interconnecting structure 50 when the rotor 14 rotates.

FIG. 9 illustrates the interaction of the assembly components when the assembly 10 rotates in a desired first direction, as represented by arrow A. When rotated in the first direction, the interconnecting arrangement 30 causes the rotor 14 and the impeller 12 to rotate in concert. Specifically, the extension rib 54 of the first interconnecting structure 40 rotates to an angular position wherein the rib 54 contacts the engagement surface 104 (FIG. 6) of the cam structure 100. The rotor 14 in essence picks up the impeller 12 and both the rotor 14 and impeller 12 freely rotate in the first direction. During this freely rotating operation, the impeller 12 and the rotor 14 are in a first axial position.

A washer 36 is positioned between the impeller 12 and the first end cap 22. The washer 36 provides a bearing surface or planar surface 42 upon which the impeller 12 can freely rotate. That is, the first end 94 of the impeller 12 contacts the planer surface 42 of the washer 36 during rotational operation of the impeller 12.

Figure 8:
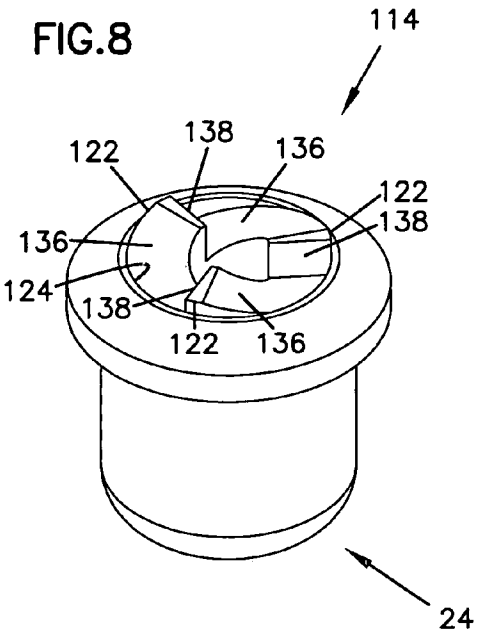
FIG. 8 is a perspective top view of one embodiment of an end cap, in accord with the principles of the present disclosure, and illustrated in FIG. 1.

The washer 36 is provided in the illustrated embodiment because each of the end caps 22, 24 is similarly configured for manufacturing purposes; that is, the first end cap 22 has the same geometry as the second end cap 24 (e.g. as shown in FIG. 8). The washer 36 prevents the impeller 12 from engaging the geometry of the first end cap 22. It is contemplated that the first end cap 22 can be configured with an integral planar surface, or include some other structure that permits free rotation of the impeller when in contact with the impeller. Further, in the illustrated embodiment, both end caps 22, 24 are made of rubber material. The washer 36 provides a planer surface 42 having a bearing-type material that does not significantly impede free rotation of the impeller 12.

When the rotor 14 starts rotating in the undesired opposite direction (as represented by arrow B in FIG. 10) the extension rib 54 of the first interconnecting structure 40 rotates to an angular position wherein the rib 54 slidably contacts the incline surface 102 (FIG. 6) of the cam structure 100. As the rotor continues to rotate, the extension rib 54 begins to travel along the incline surface 102 of the second interconnecting structure 50. As the extension rib 54 travels or translates along the incline surface 102, the rotor 14 axially travels from the first axial position to a second axial position.

As shown in FIGS. 9 and 10, the impeller 12 remains generally axially stationary, and the rotor 14 travels from the first axial position (FIG. 9) to the second axially position (FIG. 10) to engage the locking arrangement 60 of the assembly 10. Although the impeller 12 can axially "float", the impeller typically remains adjacent to the first end 32 of the shaft 20 during operation. In FIG. 9, the locking arrangement 60 is disengage, that is, the assembly 10 is free to continuously rotate in the first direction (represented by arrow A). In FIG. 10, the locking arrangement 60 is engage, that is, that assembly 10 is prevented from rotating in the second direction (represented by arrow B).

In accord with the principles disclosed, interconnecting arrangements other than a rib extension and cam surface can be used in accord with the principles disclosed. For example, the interconnecting arrangement could include a threaded channel arrangement for operably providing rotation in a first direction and preventing rotation in the second direction.

Figure 5:
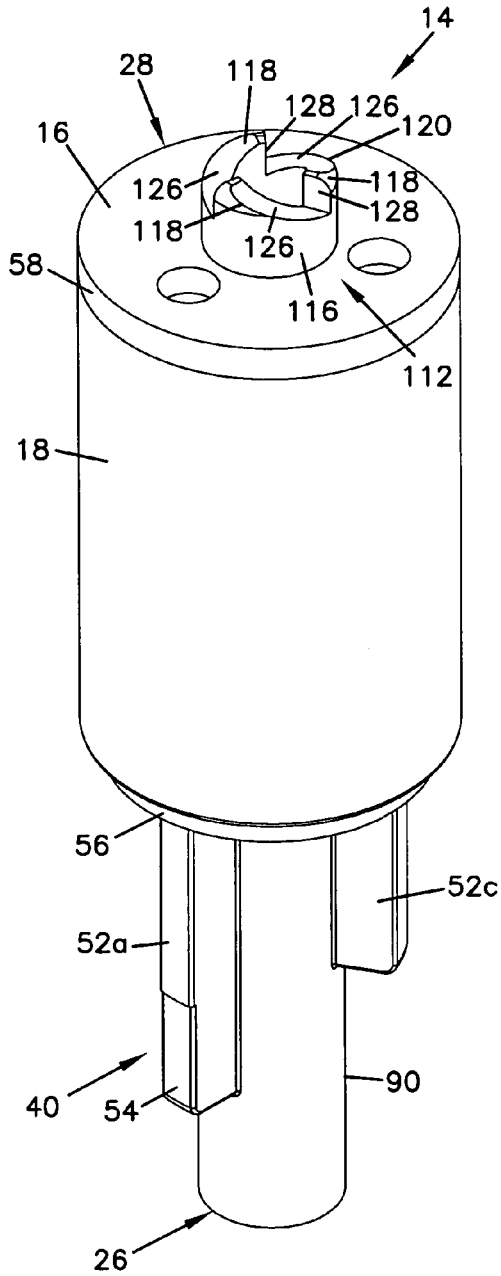
FIG. 5 is a perspective bottom view of the rotor of FIG. 4.

The locking arrangement 60 generally includes a first locking structure 112 (FIG. 5) positioned at the second end 28 of the rotor 14 and a second locking structure 114 (FIG. 8) formed within the second end cap 24 of the assembly 10. Referring to FIG. 5, the first locking structure 112 includes a locking member 116. The locking member 116 typically includes at least a first tooth 118. Preferably the first locking structure 112 includes a plurality of teeth 118 configured so as to not provide concentric misalignment during rotational operation. In the illustrated embodiment, three teeth are provided and positioned at equal angular intervals about the perimeter 120 of the locking member 116. Each of the plurality of teeth 118 includes a first ramp surface 126 and a first contact surface 128.

Referring now to FIG. 8, the locking structure 114 of the second end cap 24 includes corresponding teeth 122, that is, the teeth 122 of the second end cap 24 are configured to engage the teeth 118 of the rotor 14 (FIG. 5) to prevent rotation in the second undesired direction. Each of the corresponding teeth 122 includes a second ramp surface 136 and a second contact surface 138. The configuration of the second ramp and contact surfaces 136, 138 of the second locking structure 114 corresponds or mates with the first ramp and contact surface 126, 128 of the teeth 118 of the first locking structure 112.

As shown in FIG. 8, the corresponding teeth 122 of the second end cap 24 are at least partially formed within a recess 124 the end cap. Positioning the teeth 122 at least partially within the recess 124 prevents chatter between the corresponding teeth 122 and the teeth 118 of the locking member 116 when the rotor 14 continuously rotates in the first direction. In other words, the rotor 14 is required to travel a distance from the first axial position to the second axial position to engage the locking arrangement 60. In the first axial position, the teeth 122 of the end cap 24 do not contact the teeth 118 of the rotor 14. This is advantageous in reducing noise emission and vibrations when the assembly 10 is freely rotating in the first desired direction.

The interconnecting arrangement 30 is configured so that the rotor travels a distance from the first position to the second axial position. In the illustrated embodiment the assembly 10 is configured such that the rotor 14 travels a distance of between 0.2 cm and 1 cm (0.08 inches and 0.4 inches). As the rotor 14 is traveling it is rotating. The rotation however is limited and is not continuous. In the preferred embodiment, the assembly 10 is configured to limit rotation of the rotor 14 in the second direction to between ⅛ and ¾ revolutions. It is contemplated that other configurations of interconnecting arrangements can be used to provide other ranges of travel and limited revolutions in accord with the principles disclosed.

Referring again to FIGS. 9 and 10, once the locking arrangement 60 of the assembly 10 has been engaged, the rotor 14 is prevented from rotating in the second direction B. The motor, and accordingly the rotor, must then start up in the opposite direction, i.e. the first direction A. When the rotor begins to rotate in the first direction A, the first and second locking structures 112, 114 are configured such that the rotor 14 will ride up along the ramp surfaces 126, 136 of the locking structures 112, 114. In addition, the magnet 18 is normally drawn toward the first axial position and assists in axially moving the rotor 14 from the second axial position to the first axial position, and out of engagement with the second locking structure 114 of the second end cap 24. What is meant by normally drawn is that the magnet 18 is magnetically biased toward the first axial position and will assist in disengaging the locking arrangement 60 when the interconnecting arrangement 30 is not mechanically positioning the rotor 14 in the second axial position. When the rotor 14 returns to the first axial position, the assembly 10, including the rotor 14 and the impeller 12, is free to rotate in the first direction.

One advantage of the present assembly is that the assembly 10 can function properly in any orientation. That is, the impeller and rotor assembly 10 can be orientated in a vertical, horizontal, angled or inverted orientation during normal operations. This is because the interconnecting arrangement 30 and the locking arrangement 60 function by way of mechanical interaction and are not dependent upon gravitational forces, for example, to properly interact or operate.

Another advantage of the present assembly is that the assembly 10 is not dependent on balancing motor power with blade geometry. The principles of the present disclosure can be utilized with different impeller blade geometries to obtain different flow rates or operation efficiencies. The different impeller blade geometries can include straight blade configurations, curved blade configurations, or a configuration combining straight and curved geometries. The impeller configuration can be modified or interchanged for various reasons and applications to obtain lower power draw on the motor, for example, yet still achieve a particular target flow rate.

Yet another advantage is that by providing a known direction of rotation, flow rates can be standardized and optimized for a specific product or application. In contrast, conventional impeller designs that rotate in either a clockwise or counterclockwise direction have different flow rate results depending on the direction of rotation and cannot be reliably standardized.

The present disclosure, and the illustrated embodiment have been described and depicted as having a first desired direction of rotation, represented by arrow A in FIG. 9, and a second undesired direction of rotation, represented by arrow B in FIG. 10. In the alternative, the assembly 10 can be configured to permit continuous rotation in the direction represented by arrow B and prevent continuous rotation in the direction represented by arrow A by reversing the geometry and configuration of the disclosed components.

The above specification provides a complete description of the UNI-DIRECTIONAL IMPELLER, AND IMPELLER AND ROTOR ASSEMBLY. Since many embodiments of the invention can be made without departing from the spirit and scope of the invention, the invention resides in the claims hereinafter appended.

What is claimed is:

1. An assembly, comprising:

a) a rotor aligned with a longitudinal axis of the assembly;

b) an impeller aligned with the rotor;

c) an interconnecting arrangement configured to permit continuous rotation of the rotor and the impeller in a first direction, the arrangement including:

i) a first interconnecting structure configured to rotate in concert with the rotor; and ii) a second interconnecting structure configured to rotate in concert with the impeller, the second interconnecting structure including an interconnecting cam structure having an inclined surface and an engagement surface;

d) a locking arrangement configured to prevent continuous rotation of the rotor in a second direction opposite the first direction.

2. The assembly of claim 1, wherein the first interconnecting structure includes an extension rib that translates along the incline surface of the interconnecting cam structure when the rotor rotates in the second direction.

3. The assembly of claim 2, wherein the extension rib of the first interconnecting structure contacts the engagement surface of the interconnecting cam structure when the rotor rotates in the first direction.

4. The assembly of claim 1, wherein the interconnecting arrangement axially positions the rotor in a first axial position, along the longitudinal axis, when the rotor rotates in the first direction, and wherein the interconnecting arrangement axially positions the rotor in a second axial position, along the longitudinal axis, when the rotor rotates in the second direction.

5. The assembly of claim 4, wherein the rotor is spaced apart from the impeller when the rotor is positioned in the second position.

6. The assembly of claim 1, wherein the locking arrangement includes:

a) a first locking structure configured to rotate in concert with the rotor; and b) a second locking structure rotationally fixed relative to the first locking structure.

7. An impeller and rotor assembly, comprising:

a) a shaft having a first end and a second end;

b) a rotor mounted on the shaft adjacent to the first end of the shaft, the rotor including:

i) a first end and a second end;

ii) a first interconnecting structure positioned at the first end of the rotor;

iii) a first locking structure positioned at the second end of the rotor;

c) an impeller mounted on the shaft adjacent to the second end of the shaft, the impeller having a second interconnecting structure;

d) a first end cap mounted on the first end of the shaft;

e) a second end cap mounted on the second end of the shaft, the second end cap including a second locking structure corresponding to the first locking structure of the rotor to prevent rotation of the rotor in a predetermined direction.

8. The impeller and rotor assembly of claim 7, wherein the first interconnecting structure includes an engagement rib extending from the first end of the rotor.

9. The impeller and rotor assembly of claim 8, wherein the second interconnecting structure includes a cam structure having an incline surface and an engagement surface.

10. The impeller and rotor assembly of claim 9, wherein the engagement rib of the first interconnecting structure slidably contacts the inclined surface of the second interconnecting structure when the rotor rotates in the predetermined direction.

11. The impeller and rotor assembly of claim 10, wherein the engagement rib of the first interconnecting structure contacts the engagement surface of the second interconnecting structure when the rotor rotates in a direction opposite the predetermined direction.

12. The impeller and rotor assembly of claim 7, wherein the first locking structure of the rotor includes a locking member having teeth, and the second locking structure of the second end cap includes corresponding teeth, the teeth of the rotor being configured to engage the corresponding teeth of the second end cap to prevent rotation in the predetermined direction.

13. The impeller and rotor assembly of claim 12, wherein the corresponding teeth of the second end cap are formed within a recess of the end cap such that the teeth of the rotor engage the teeth of the second end cap only when the rotor is axially positioned apart from the impeller.

14. A method of limiting rotation of a motor in a predetermined direction, the method comprising:

a) providing a rotor coupled to a motor and including a locking structure, and an impeller interconnected to the rotor;

b) axially displacing the rotor from a first position adjacent to the impeller to a second position located a distance from the impeller when the motor rotates in the predetermined direction, the rotor being displaced by sliding contact with a helical structure of the impeller;

c) engaging the locking structure of the rotor with a fixed arrangement to prevent continuous rotation of the motor in the predetermined direction.

15. The method of claim 14, further including:

a) disengaging the locking structure and returning the rotor to the first position when the motor begins to rotate in a direction opposite the predetermined direction; and b) continuously rotating the motor in the direction opposite the predetermined direction.

16. An impeller for use with a permanent magnetic motor, the impeller comprising:

a) a main body;

b) a plurality of blades extending from the main body;

c) a cam structure connected to the main body, the cam structure including an incline surface and an engagement surface, the cam structure being configured to provide contact between the engagement surface of the cam structure and a component of the permanent magnetic motor when the motor rotates the component in a first direction, and provide contact between the incline surface of the cam structure and the component of the permanent magnetic motor when the component of the motor rotates in a second opposite direction.

17. The impeller of claim 16, wherein the main body includes a central bore, and the cam structure is formed on the inside diameter of the central bore.

18. The impeller of claim 16, wherein the blades of the impeller are straight blades.

19. An assembly, comprising:

a) a rotor aligned with a longitudinal axis of the assembly;

b) an impeller aligned with the rotor;

c) an interconnecting arrangement configured to permit continuous rotation of the rotor and the impeller in a first direction, the arrangement including:

i) a first interconnecting structure configured to rotate in concert with the rotor; and ii) a second interconnecting structure configured to rotate in concert with the impeller;

iii) wherein the interconnecting arrangement axially positions the rotor in a first axial position, along the longitudinal axis, when the rotor rotates in the first direction, and wherein the interconnecting arrangement axially positions the rotor in a second axial position, along the longitudinal axis, when the rotor rotates in the second direction; and d) a locking arrangement configured to prevent continuous rotation of the rotor in a second direction opposite the first direction.

20. The assembly of claim 19, wherein the rotor is spaced apart from the impeller when the rotor is positioned in the second position.

* * * * *